US008390871B2

(12) United States Patent
Morikawa

(10) Patent No.: US 8,390,871 B2
(45) Date of Patent: Mar. 5, 2013

(54) IMAGE FORMING APPARATUS AND COMPUTER READABLE MEDIUM

(75) Inventor: Jun Morikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1177 days.

(21) Appl. No.: 12/053,768

(22) Filed: Mar. 24, 2008

(65) Prior Publication Data

US 2008/0239397 A1 Oct. 2, 2008

(30) Foreign Application Priority Data

Mar. 28, 2007 (JP) ..... 2007-084774

(51) Int. Cl.
*G06K 15/00* (2006.01)
*G06F 3/12* (2006.01)

(52) U.S. Cl. ..... 358/1.18; 358/1.1

(58) Field of Classification Search ..... 358/1.1, 358/1.2, 1.6, 1.9, 1.11, 1.12, 1.13, 1.15, 1.16, 358/1.17, 1.18, 1.14, 500, 501, 538, 540, 358/400, 401, 449, 450, 451, 452, 453; 715/200, 715/204, 232, 235, 243, 247, 251, 274, 277; 347/2, 3, 5, 14, 23; 101/483, 485, 484; 382/284, 382/287, 282
See application file for complete search history.

(56) References Cited

U.S. PATENT DOCUMENTS 5,140,647 A * 8/1992 Ise et al. ..... 382/284
6,857,798 B2 2/2005 Matsuyama
2008/0141885 A1 * 6/2008 Hu ..... 101/483

FOREIGN PATENT DOCUMENTS

| | | | |
|---|---|---|---|
| JP | H05-037768 | A | 2/1993 |
| JP | H05-041790 | A | 2/1993 |
| JP | H06-040086 | A | 2/1994 |
| JP | H06-155848 | A | 6/1994 |
| JP | H09-046510 | A | 2/1997 |
| JP | H11-157162 | A | 6/1999 |

(Continued)

OTHER PUBLICATIONS

English Machine Translation of JP 2004255725 A.*

(Continued)

*Primary Examiner* — Dov Popovici
(74) *Attorney, Agent, or Firm* — Baker Botts L.L.P.

(57) ABSTRACT

An image forming apparatus includes a formation unit and an overlap order number assignment unit. The formation unit divides a predetermined image and forms divided images of the predetermined image on plurality sheets of recording paper in a divided manner. The formation unit forms the divided images such that, among the plurality sheets of recording paper, on which the divided images are formed by the formation unit, at least one of the plurality sheets of recording paper includes an overlap portion used for overlapping the at least one of the plurality sheets of recording paper with a remainder of the plurality sheets of recording paper. The overlap order number assignment unit assigns the at least one of the plurality sheets of recording paper with an overlap order number, indicating an overlap order for overlapping the plurality sheets of recording paper, in the overlap portion.

20 Claims, 7 Drawing Sheets

FOREIGN PATENT DOCUMENTS

| | | | | |
|---|---|---|---|---|
| JP | 2000-238364 | A | | 9/2000 |
| JP | 2004-098656 | A | | 4/2004 |
| JP | 2004-255725 | A | | 9/2004 |
| JP | 2004255725 | A | * | 9/2004 |
| JP | 2005-025386 | A | | 1/2005 |
| JP | 2005-167373 | A | | 6/2005 |
| JP | 2006-040218 | A | | 2/2006 |

OTHER PUBLICATIONS

Japan Patent Office, Notice of Reasons for Rejection in Japanese Patent Application No. 2007-084774 mailed Mar. 3, 2009.

Japan Patent Office; Decision of Rejection in Japanese Patent Application No. 2007-084774 mailed Jul. 21, 2009 (partial translation).

The State Intellectual Property Office of the People'S Republic of China; Notification of First Office Action in Chinese Patent Application No. 200810086185.7 mailed Mar. 1, 2010.

The State Intellectual Property Office of the People'S Republic of China, Notification of the Second Office Action for Chinese Patent Application No. 200810086185.7, issued Aug. 3, 2011.

Patent Office of the People'S Republic of China, Decision on Rejection for Chinese Patent Application No. 200810086185.7, issued Sep. 4, 2012.

The State Intellectual Property Office of the People'S Republic of China, Notification of the Third Office Action for Chinese Patent Application No. 200810086185.7, issued Mar. 14, 2012.

* cited by examiner

READ-OUT AREA
A=B=C=D

IMAGE FORMING APPARATUS AND COMPUTER READABLE MEDIUM

CROSS-REFERENCE TO RELATED APPLICATION

This application claims the benefit of Japanese Patent Application No. 2007-84774 filed Mar. 28, 2007 in the Japan Patent Office, the disclosure of which is incorporated herein by reference.

BACKGROUND

This invention relates to an image forming apparatus having a poster copy function wherein a predetermined image is divided and the divided images are recorded on plurality sheets of recording paper. The present invention also relates to a computer-readable medium that stores a program that is necessary for such image formation.

When poster copying is performed in a conventional image forming apparatus, among plurality sheets of recording paper, on which divided images are formed, at least one of the plurality sheets of recording paper is provided with a margin to be used for a bond width.

However, recording paper is simply provided with bond widths in the above-described conventional image forming apparatus. Consequently, there has been a problem in that a user might make an error in the order for applying glue on the bond widths, and pasting plurality sheets of recording paper to one another can possibly take time.

SUMMARY

One aspect of the present invention provides an image forming apparatus that can simplify pasting of recording paper performed by a user.

An image forming apparatus according to one aspect of the present invention may include a formation unit and an overlap order number assignment unit. The formation unit divides a predetermined image and forms divided images of the predetermined image on plurality sheets of recording paper in a divided manner. The formation unit preferably forms the divided images such that, among the plurality sheets of recording paper, on which the divided images are formed by the formation unit, at least one of the plurality sheets of recording paper includes an overlap portion used for overlapping the at least one of the plurality sheets of recording paper with a remainder of the plurality sheets of recording paper. The overlap order number assignment unit assigns the overlap portion with an overlap order number, indicating an overlap order for overlapping the plurality sheets of recording paper, in the overlap portion.

Another aspect of the present invention relates to a computer-readable medium including an image formation program stored therein. The computer-readable medium is readable by a computer device that controls an image forming apparatus. The image formation program preferably allows the computer device so as to serve as a formation module and an overlap order number assignment module.

The formation module controls the image forming apparatus so as to divide a predetermined image and to form divided images of the predetermined image on plurality sheets of recording paper in a divided manner. The formation module preferably controls the image forming apparatus such that, among the plurality sheets of recording paper, on which the divided images are formed by the formation module, at least one of the plurality sheets of recording paper includes an overlap portion used for overlapping the at least one of the plurality sheets of recording paper with a remainder of the plurality sheets of recording paper. The overlap order number assignment module controls the image forming apparatus so as to assign the overlap portion with an overlap order number, indicating an overlap order for overlapping the plurality sheets of recording paper.

It should be noted that the above-described image formation program may be provided to a user through a medium, such as a FD, a CD-ROM, a DVD-ROM, a memory card and so on, which is readable by the above-described computer device. Moreover, the above-described program may be provided to a user in a state wherein the program is preinstalled into a medium, such as a hard disk, a memory, and so on, of a computer device. Furthermore, the above-described program may be provided to a user through a communication network, such as Internet and the like.

Still furthermore, the above-described computer device for executing the above-described program may be, for example, a computer device installed in the above-described image forming apparatus, or may be a separate computer device that is communicable with the above-described image forming apparatus.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

In the following embodiments, the image forming apparatus according to the present invention is applied to a so-called multifunction apparatus including a printer function, scanner function, a color copy function, and a facsimile function.

[First Embodiment]

1. General Description of Multifunction Apparatus

Figure 1:
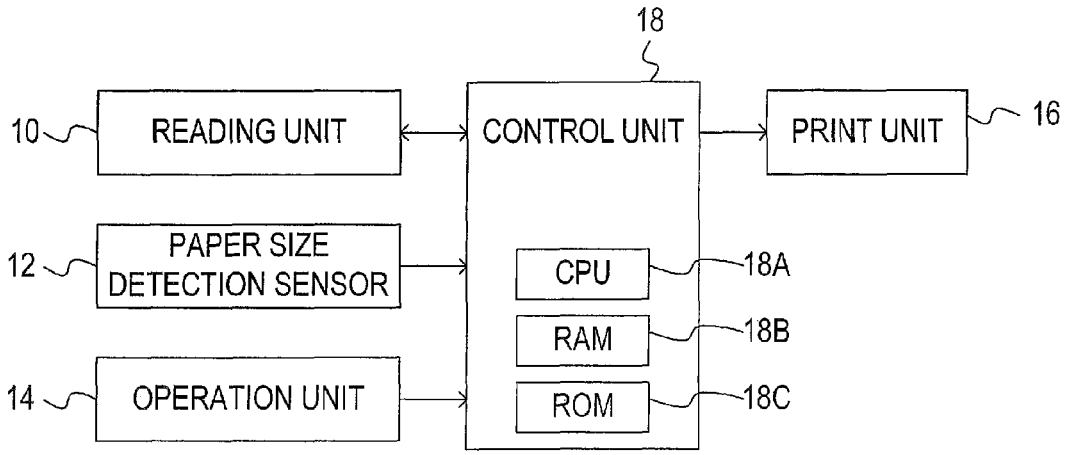
FIG. 1 is a block diagram showing the structure of a multifunction apparatus according to a first embodiment of the present invention.

As shown in FIG. 1, a multifunction apparatus according to the present embodiment includes a reading unit 10, a paper size detection sensor 12, an operation unit 14, a print unit 16, and a control unit 18. The reading unit 10 reads an image on recording paper placed on a placement tray (not shown). The paper size detection sensor 12 detects the size of recording paper read by the reading unit 10. The operation unit 14 is operated by a user. The print unit 16 prints (forms) an image on recording paper. The control unit 18 controls the multifunction apparatus. The control unit 18 is constituted by a computer device including a CPU 18A, a RAM 18B, and a ROM 18C.

In addition to the above-described functions, the multifunction apparatus according to the present embodiment is provided with a poster copy function wherein an image read by the reading unit 10 (to be referred to as a read-out image) is divided into plurality sections, the plurality sections are enlarged at a predetermined magnification, and each of the plurality sections divided and enlarged as above (to be referred to as divided-enlarged images) is printed on each of plurality sheets of recording paper separately. In other words, poster copy is performed based on a read-out image in the present embodiment.

2. Poster Copy

In poster copy performed according to the present embodiment, a read-out image (corresponding to one sheet of recording paper) is enlarged approximately twice in the longitudinal and the lateral directions, and the divided-enlarged images of the read-out image are printed on four sheets of recording paper. In the present embodiment, the four sheets of recording paper, on which printing is performed, are aligned into a 2 (row)×2 (column) form, and overlapped on bond widths 20 (see FIG. 2) formed on the sheets of recording paper. As a result, an enlarged image can be formed wherein the read-out image is enlarged at a predetermined magnification (approximately four times).

Figure 2:
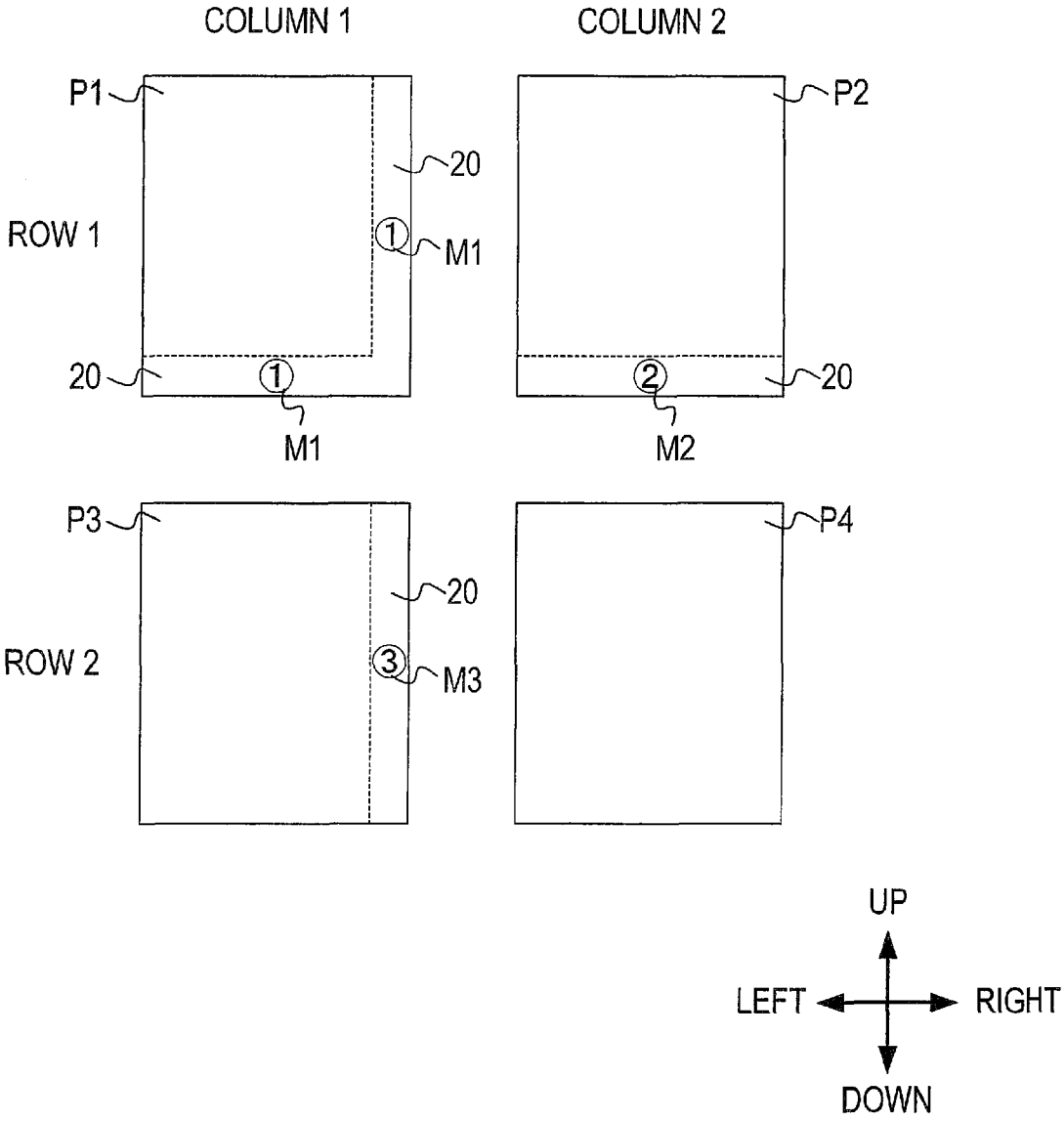
FIG. 2 is an explanatory view illustrating sheets of recording paper outputted by the multifunction apparatus when divided-enlarged images are outputted.

As shown in FIG. 2, in a state (to be referred to as a complete state) wherein four sheets of recording paper P1-P4, on which the divided-enlarged images are formed, are overlapped on the respective bond widths 20 such that the divided-enlarged images match with one another, the lateral alignment (in the left-to-right direction) is referred to as "Row", whereas the longitudinal alignment (in the up-and-down direction) is referred to as "Column". For example, the recording paper P1, which is disposed in the upper left position in the complete state, is disposed, as shown in FIG. 2, in Row 1, Column 1.

Furthermore, in the present embodiment, when divided-enlarged images are printed, as shown in FIG. 2, among recording paper P1-P4 outputted from the print unit 16 when the divided-enlarged images are printed, the recording paper P1-P3 (the recording paper outputted first to third) are provided with bond widths 20, whereas no bond width 20 is formed on the recording paper P4 which is outputted last. On the respective bond widths 20, overlap order number marks M1, M2, M3, which indicate an overlap order for overlapping the recording paper P1-P4, are printed.

The overlap order number marks M1-M3 also indicate the placement positions of the respective sheets of recording paper in the complete state. In the present embodiment, the numbers indicated in the overlap order number marks M1-M3 become larger from the recording paper P1, which is to be disposed in Row 1, Column 1 (in the upper left position), toward the right side. After Row 1, the numbers indicated in the overlap order number marks M1-M3 become larger from the left side in Row 2 toward the right side.

Specifically, in the bond width 20 of the recording paper P1, to be disposed in Row 1, Column 1 in the complete state, an overlap order number mark M1, indicating "1", is assigned. In the bond width 20 of the recording paper P2, to be disposed in Row 1, Column 2 in the complete state, an overlap order number mark M2, indicating "2", is assigned. In the bond width 20 of the recording paper P3, to be disposed in Row 2, Column 1 in the complete state, an overlap order number mark M3, indicating "3", is assigned.

No overlap order number mark is assigned to the recording paper P4, to be disposed in Row 2, Column 2 in the complete state, since a bond width 20 does not have to be provided to the recording paper P4.

In the present embodiment, the sheets of recording paper P1-P3 are outputted in the order from a sheet of recording paper having a smaller number indicated in the overlap order number mark. Specifically, the recording paper P1, having the overlap order number mark M1 in which "1" is indicated, is outputted first. The recording paper P2, having the overlap order number mark M2 in which "2" is indicated, is outputted second. The recording paper P3, having the overlap order number mark M3 in which "3" is indicated, is outputted third. Then, the recording paper P4 without any overlap order number mark is outputted last (fourth).

3. Distinctive Operation of Multifunction Apparatus

Figure 3:
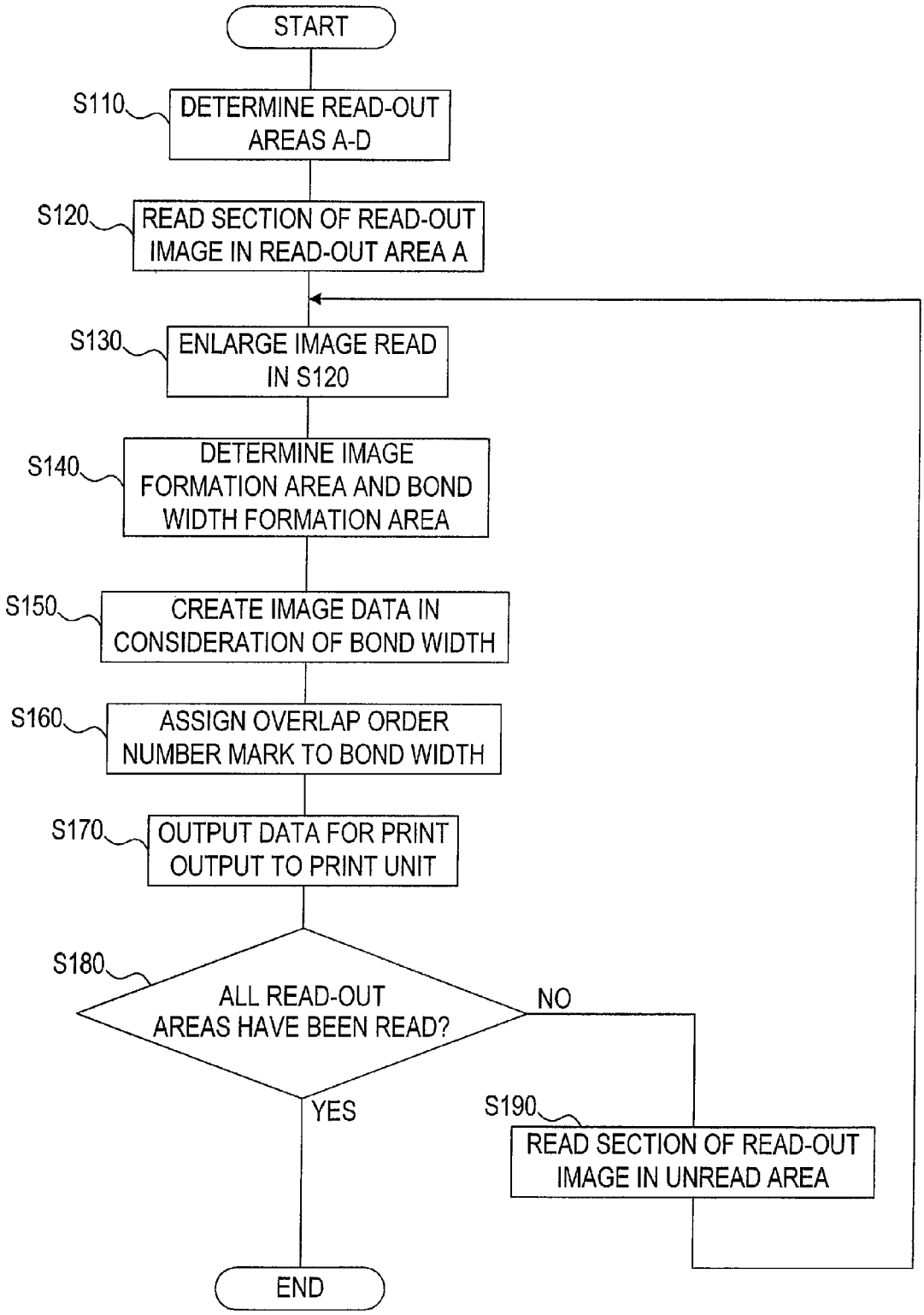
FIG. 3 is a flowchart describing a distinctive operation of a program according to the first embodiment for controlling a print unit by a CPU of a control unit.

The process of a program shown in FIG. 3 is performed for controlling the print unit 16 by the CPU 18A of the control unit 18. This process is performed when printing by using the poster copy function is chosen by a user. This program is stored in the ROM 18C.

When the program shown in FIG. 3 is initiated, in S110, based on a detection signal inputted from the paper size detection sensor 12, read-out areas A-D (see FIG. 4) of a read-out image, which will be read by the reading unit 10 in S120 and S190 (to be explained later), are determined.

Figure 4:
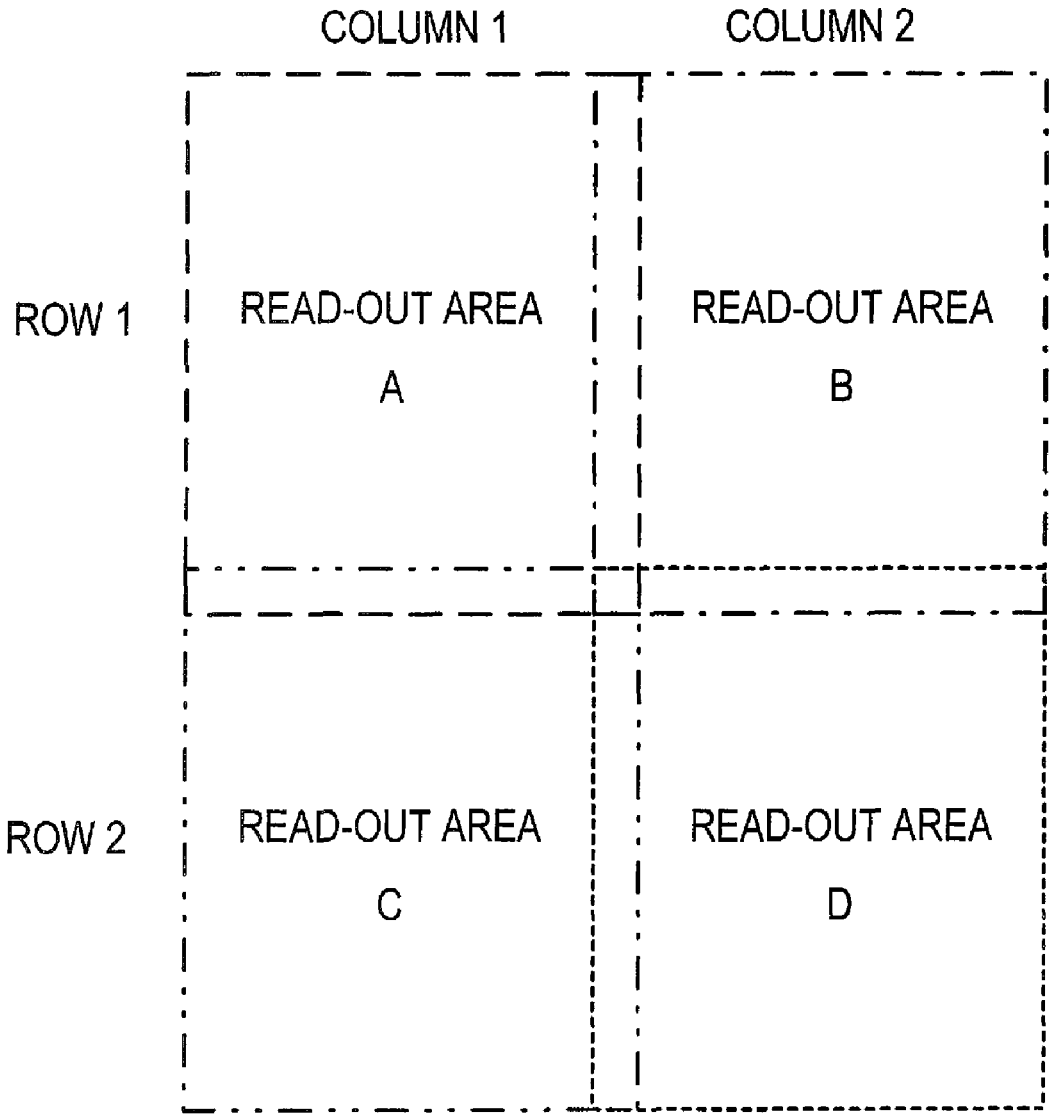
FIG. 4 is an explanatory view illustrating read-out areas according to the first embodiment.

As shown in FIG. 4, the read-out areas A-D are constituted with areas aligned in two rows and two columns (four areas). Since bond widths 20 are supposed to be formed on the recording paper P1-P3, the sizes (areas) of the respective read-out areas A-D are determined to be approximately equivalent sizes in consideration that some portions of the read-out image in the respective read-out areas A-D will be overlapped by bond widths 20.

Therefore, the read-out areas A-D include some portions of the read-out image, read by the reading unit 10, which overlap in adjacent read-out areas, so that bond widths 20 can be formed on the recording paper P1-P3.

When the read-out areas A-D are determined in S110, the process proceeds to S120, wherein a section of the read-out image, included within the read-out area A positioned in Row 1, Column 1, is read by the reading unit 10.

When the section of the read-out image, included within the read-out area A, is read in S120, the process proceeds to S130, wherein the section of the read-out image which has been read out as described above (to be referred to as a divided read-out image) is enlarged so as to be as large as the size of the recording paper detected by the paper size detection sensor 12.

Subsequently, in S140, an image formation area and a bond width formation area are determined in the divided read-out image enlarged as above. The image formation area is used for forming (printing) a divided-enlarged image on the recording paper P1. The bond width formation area is used for forming the bond width 20 on the recording paper P1.

The image formation area mentioned here is an area in which the divided read-out image enlarged in S130 is formed on the recording paper P1 without any change. The image formed in the image formation area is referred to as a divided-enlarged image in the present embodiment.

In the read-out area A, the portion that overlaps with the read-out area B positioned in Row 1, Column 2, and the portion that overlaps with the read-out area C positioned in Row 2, Column 1 are determined as a bond width formation area. The remaining portion of the read-out area A, excluding the bond width formation area, is determined as the image formation area.

When the image formation area and the bond width formation area are determined in S140, the process proceeds to S150, wherein, in the divided read-out image enlarged in S130, the portion that corresponds to the bond width formation area, is deleted (blanked).

When the portion of the divided read-out image, corresponding to the bond width formation area, is blanked in S150, the process proceeds to S160, wherein data for print output is created, in which the overlap order number mark M1 is assigned in the blank portion (the bond width 20) (see FIG. 2). Then, in S170, the data for print output is outputted to the print unit 16.

Consequently, printing is performed based on the data for print output. As a result, the divided-enlarged image corresponding to the read-out area A, the bond width 20, and the overlap order number mark M1 are formed on the recording paper P1, which will be disposed in Row 1, Column 1 in the complete state.

When the data for print output is outputted to the print unit 16 in S170, the process proceeds to S180, wherein it is determined whether or not all the divided read-out images (the entire portion of the read-out image) have been read by the reading unit 10.

If it is determined that not all the divided read-out images have been read (S180:NO), the process proceeds to S190, wherein one of the read-out areas A-D, which has not been read, is selected, and the section of read-out image included in the selected read-out area (divided read-out image) is read.

In S190, the read-out areas B, C, D are determined to be selected in the alphabetical order. When one of the divided read-out images is read in S190, the processes in S130-S170 are performed with respect to the divided read-out image read in S190.

Specifically, when the section of the read-out image included in the read-out area B, positioned in Row 1, Column 2, is read in S190, the image read in S190 (divided read-out image) is enlarged in S130. Then, as shown in FIG. 4, in S140, the portion of the divided read-out image that overlaps with the read-out area D, positioned in Row 2, Column 2, is determined as a bond width formation area, and the remaining portion of the read-out area B, excluding the bond width formation area, is determined as an image formation area.

In S150, the portion of the divided read-out image that corresponds to the bond width formation area is blanked. In S160, data for print output is created wherein the overlap order number mark M2 is assigned in the blank portion (see FIG. 2). In S170, the data for print output is outputted to the print unit 16.

As a result, the divided-enlarged image corresponding to the read-out area B, the bond width 20, and the overlap order number mark M2 are formed on the recording paper P2, which will be disposed in Row 1, Column 2 in the complete state.

When the section of the read-out image included in the read-out area C, positioned in Row 2, Column 1, is read in S190, subsequent to the process in S130, the portion of the divided read-out image that overlaps with the read-out area D, positioned in Row 2, Column 2, is determined as a bond width formation area, and the remaining portion of the read-out area C, excluding the bond width formation area, is determined as an image formation area in S140.

In S150, the portion of the divided read-out image that corresponds to the bond width formation area is blanked. In S160, data for print output is created, wherein the overlap order number mark M3 is assigned in the blank portion (see FIG. 2). In S170, the data for print output is outputted to the print unit 16.

As a result, the divided-enlarged image corresponding to the read-out area C, the bond width 20, and the overlap order number mark M3 are formed on the recording paper P3, which will be disposed in Row 2, Column 1 in the complete state.

When the section of the read-out image included in the read-out area D, positioned in Row 2, Column 2, is read in S190, subsequent to the process in S130, the entire portion of the read-out area D is determined as an image formation area in S140. That is, no bond width formation area is determined. Then, data for print output in regard to the entire portion of the divided read-out image enlarged in S130 (divided-enlarged image) is created in S150, S160. In S170, the data for print output is outputted to the print unit 16.

As a result, the divided-enlarged image corresponding to the read-out area D is printed on the recording paper P4, which will be disposed in Row 2, Column 2 in the complete state.

When it is determined that all the divided read-out images have been read (S180:YES), the process of the present program is over.

4. Pasting Recording Paper P1-P4

A user can paste the sheets of recording paper P1-P4, on which divided-enlarged images are formed, to one another according to, for example, a process described below.

First of all, a user applies glue on the bond width 20 of the recording paper P1 assigned with the overlap order number mark M1 (outputted first from the print unit 16).

Next, the user pastes the left end portion of the recording paper P2 onto the bond width 20 of the recording paper P1 (the bond width 20 formed in the right end of the recording paper P1) such that the recording paper P2, assigned with the overlap order number mark M2 (outputted second from the print unit 16), is disposed in Row 1, Column 2 in the complete state. Then, the user applies glue on the bond width 20 of the recording paper P2.

Subsequently, the user pastes the top end portion of the recording paper P3 onto the bond width 20 of the recording paper P1 (the bond width 20 formed in the bottom end of the recording paper P1) such that the recording paper P3, assigned with the overlap order number mark M3 (outputted third from the print unit 16), is disposed in Row 2, Column 1 in the complete state. Then, the user applies glue on the bond width 20 of the recording paper P3.

Lastly, the user pastes the top end portion of the recording paper P4 onto the bond width 20 of the recording paper P2 and pastes the left end portion of the recording paper P4 onto the bond width 20 of the recording paper P3 such that the recording paper P4 having no bond width 20 (outputted last from the print unit 16) is disposed in Row 2, Column 2 in the complete state.

5. Feature of Multifunction Apparatus according to Present Embodiment

In the present embodiment, the sheets of recording paper P1-P3, on which divided-enlarged images are formed, are respectively assigned with the overlap order number marks M1-M3. Therefore, a user can paste the recording paper P1-P4 by simply applying glue on the bond widths 20, and overlapping the sheets of recording paper P1-P4 according to the order indicated by the overlap order number marks M1-M3 (M1→M2→M3→(no bond width 20)).

Therefore, an error caused by a user in regard to the overlapping order of the recording paper P1-P4 can be inhibited. As a result, the amount of work for pasting the recording paper P1-P4 can be saved, and the process for pasting the recording paper P1-P4 by a user can be simplified.

Moreover, since the overlap order number marks M1-M3 are provided on the bond widths 20 in the present embodiment, the overlap order number marks M1-M3 become invisible in the complete state (wherein the sheets of recording paper P1-P4 are overlapped on one another). Therefore, the overlap order number marks M1-M3 can be inhibited from disturbing the complete state.

Furthermore, in the present embodiment, the overlap order number marks M1-M3 are provided on the front surfaces of the respective sheets of recording paper P1-P3, on which the bond widths 20 are formed. Unlike the case, for example, wherein the overlap order number marks M1-M3 are provided on the back surfaces of the sheets of recording paper P1-P3, a user does not have to turn over the sheets of recording paper P1-P4, on which divided-enlarged images are formed, in order to check the overlap order number marks M1-M3. Therefore, the process for pasting the recording paper P1-P4 by a user can be simplified.

Still furthermore, printing on the recording paper P1-P3 is performed in distinction between the bond widths 20 and the divided-enlarged images. Therefore, a user can be clearly aware of the areas for overlapping the respective sheets of recording paper P1-P4, and correctly perform pasting of the recording paper P1-P4.

Moreover, since the overlap order number marks M1-M3 according to the present embodiment indicate the placement positions of the recording paper P1-P4 in the complete state, when a user overlaps the sheets of recording paper P1-P4, on which divided-enlarged images are formed, the user can be aware of the placement positions of the respective sheets of recording paper P1-P4. Therefore, the process for pasting the recording paper P1-P4 can be simplified.

Furthermore, the sheets of recording paper P1-P3, having the bond widths 20 formed thereon, are externally outputted in the order from the sheet of recording paper having a smaller number indicated in the overlap order number mark. Therefore, a user can overlap the sheets of recording paper P1-P4 in the order of the recording paper P1-P4 sequentially outputted from the multifunction apparatus (the print unit 16). As a result, the efficiency in the pasting process can be improved.

Still furthermore, in the present embodiment, the bond widths 20 are formed on the recording paper P1-P3, but not on the recording paper P4, which is externally outputted last among the recording paper P1-P4. Therefore, the recording paper P4 outputted last from the multifunction apparatus (the print unit 16) is to be simply placed over the bond widths 20 formed on other recording paper P1-P3.

In addition, since the order for applying glue on the bond widths 20 and the order for overlapping the recording paper P1-P4 are the same, the process for pasting the recording paper P1-P4 by a user can be further simplified.

6. Correspondence Relations between Present Invention and Embodiment

The bond width 20 in the present embodiment corresponds to an example of the overlap portion disclosed in the claims of the present invention. The composition that performs the processes in S130 and S170 corresponds to an example of the formation unit and the formation module. The composition that performs the process in S140 corresponds to an example of the overlap portion formation unit and the overlap portion formation module. The composition that performs the process in S160 corresponds to an example of the overlapping order assignment unit and the overlapping order assignment module.

[Second Embodiment]

In the poster copy function according to the above-described embodiment, a read-out image is enlarged twice respectively in the longitudinal and the lateral directions. In the poster copy function according to the present embodiment, a read-out image is enlarged three times respectively in the longitudinal and the lateral directions.

Figure 5:
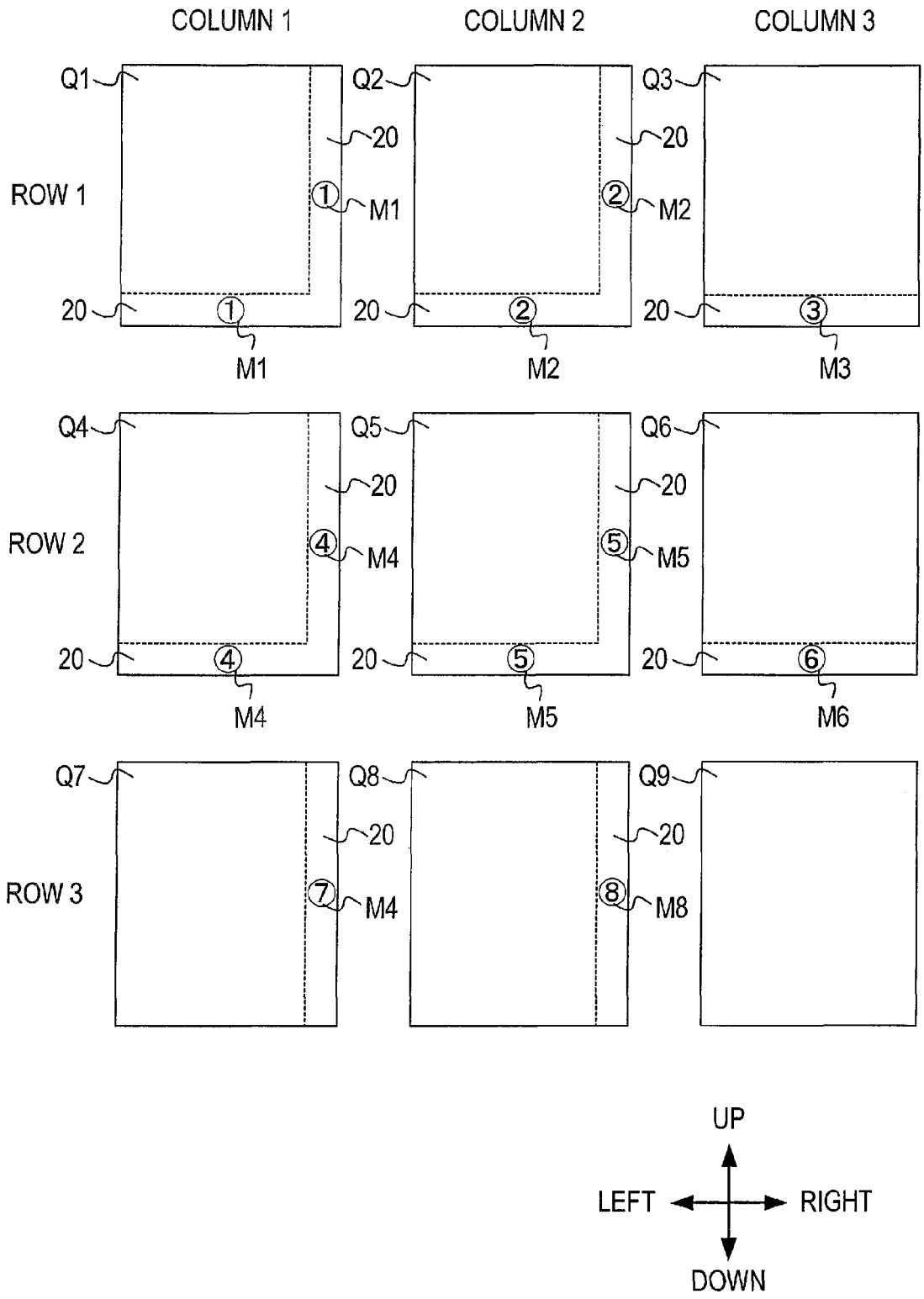
FIG. 5 is an explanatory view illustrating sheets of recording paper outputted by a multifunction apparatus according to a second embodiment when divided-enlarged images are outputted.

As shown in FIG. 5, on a recording paper Q1, which will be disposed in Row 1, Column 1 in a complete state, a bond width 20 is formed (in the right end portion of the recording paper Q1) in a portion to be overlapped with a recording paper Q2, which will be disposed in Row 1, Column 2 in the complete state. Additionally, the bond width 20 of the recording paper Q1 is formed (in the bottom end portion of the recording paper Q1) in a portion to be overlapped with a recording paper Q4, which will be disposed in Row 2, Column 1 in the complete state. The bond width 20 of the recording paper Q1 is assigned with an overlap order number mark M1 indicating "1".

On the recording paper Q2, which will be disposed in Row 1, Column 2 in the complete state, a bond width 20 is formed (in the right end portion of the recording paper Q2) in a portion to be overlapped with a recording paper Q3, which will be disposed in Row 1, Column 3 in the complete state. Additionally, the bond width 20 of the recording paper Q2 is formed (in the bottom end portion of the recording paper Q2) in a portion to be overlapped with a recording paper Q5, which will be disposed in Row 2, Column 2 in the complete state. The bond width 20 of the recording paper Q2 is assigned with an overlap order number mark M2 indicating "2".

On the recording paper Q3, which will be disposed in Row 1, Column 3 in the complete state, a bond width 20 is formed (in the bottom end portion of the recording paper Q3) in a portion to be overlapped with a recording paper Q6, which will be disposed in Row 2, Column 3 in the complete state. The bond width 20 of the recording paper Q3 is assigned with an overlap order number mark M3 indicating "3".

On the recording paper Q4, which will be disposed in Row 2, Column 1 in the complete state, a bond width 20 is formed (in the right end portion of the recording paper Q4) in a portion to be overlapped with the recording paper Q5, which will be disposed in Row 2, Column 2 in the complete state. Additionally, the bond width 20 of the recording paper Q4 is formed (in the bottom end portion of the recording paper Q4) in a portion to be overlapped with a recording paper Q7, which will be disposed in Row 3, Column 1 in the complete state. The bond width 20 of the recording paper Q4 is assigned with an overlap order number mark M4 indicating "4".

On the recording paper Q5, which will be disposed in Row 2, Column 2 in the complete state, a bond width 20 is formed (in the right end portion of the recording paper Q5) in a portion to be overlapped with the recording paper Q6, which will be disposed in Row 2, Column 3 in the complete state. Additionally, the bond width 20 of the recording paper Q5 is formed (in the bottom end portion of the recording paper Q5) in a portion to be overlapped with a recording paper Q8, which will be disposed in Row 3, Column 2 in the complete state. The bond width 20 of the recording paper Q5 is assigned with an overlap order number mark M5 indicating "5".

On the recording paper Q6, which will be disposed in Row 2, Column 3 in the complete state, a bond width 20 is formed (in the bottom end portion of the recording paper Q6) in a portion to be overlapped with a recording paper Q9, which will be disposed in Row 3, Column 3 in the complete state. The bond width 20 of the recording paper Q6 is assigned with an overlap order number mark M6 indicating "6".

On the recording paper Q7, which will be disposed in Row 3, Column 1 in the complete state, a bond width 20 is formed (in the right end portion of the recording paper Q7) in a portion to be overlapped with the recording paper Q8, which will be disposed in Row 3, Column 2 in the complete state. The bond width 20 of the recording paper Q7 is assigned with an overlap order number mark M7 indicating "7".

On the recording paper Q8, which will be disposed in Row 3, Column 2 in the complete state, a bond width 20 is formed (in the right end portion of the recording paper Q8) in a portion to be overlapped with the recording paper Q9, which will be disposed in Row 3, Column 3 in the complete state. The bond width 20 of the recording paper Q8 is assigned with an overlap order number mark M8 indicating "8". The recording paper Q9, which will be disposed in Row 3, Column 3 in the complete state, is not provided with any overlap order number mark, since there is no need to form any bond width 20 thereon.

In the present embodiment described above, the overlap order number marks M1-M8 are provided, in the same manner as in Embodiment 1, to the recording paper Q1-Q8, on which divided-enlarged images are formed.

Therefore, pasting of the recording paper Q1-Q9 can be performed by applying glue on the bond widths 20 and overlapping the sheets of recording paper Q1-Q9 according to the order indicated by the overlap order number marks M1-M8 (M1→M2→M3→M4→M5→M6→M7→M8 (no bond width 20)).

[Third Embodiment]

In the present embodiment, the order for overlapping the recording paper P1-P4 (externally outputted when divided-enlarged images are outputted) is changed from the order described in Embodiment 1.

Figure 6:
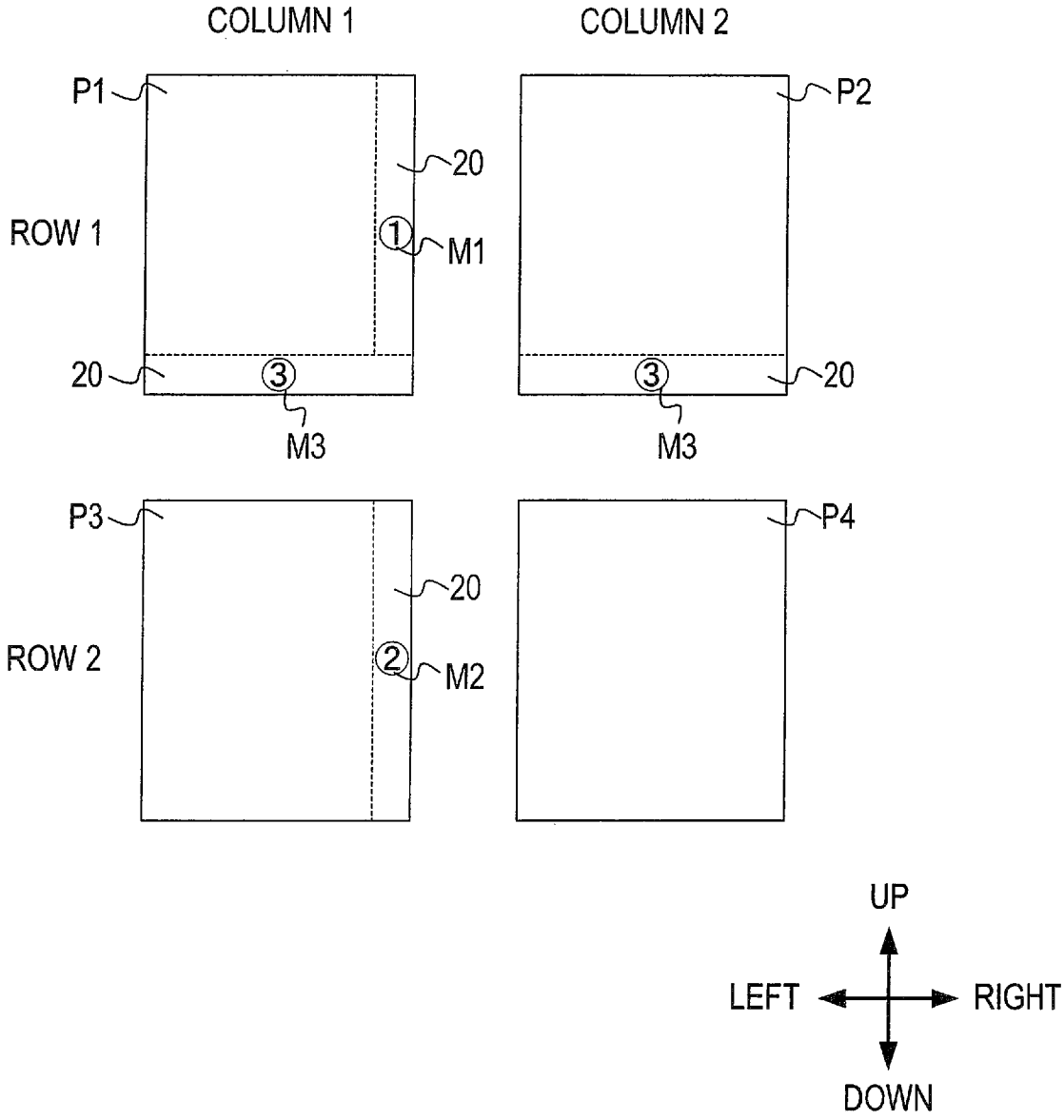
FIG. 6 is an explanatory view illustrating sheets of recording paper outputted by a multifunction apparatus according to a third embodiment when divided-enlarged images are outputted.

As shown in FIG. 6, the bond width 20 of the recording paper P1, which will be disposed in Row 1, Column 1 in a complete state, is assigned with an overlap order number mark M1 in the portion (in the right end portion of the recording paper P1) to be overlapped with the recording paper P2. The bond width 20 of the recording paper P1 is also assigned with an overlap order number mark M3 in the portion (in the bottom end portion of the recording paper P1) to be overlapped with the recording paper P3.

The bond width 20 of the recording paper P2, which will be disposed in Row 1, Column 2 in the complete state, is assigned with an overlap order number mark M3. The bond width 20 of the recording paper P3, which will be disposed in Row 2, Column 1 in the complete state, is provided with an overlap order number mark M2.

[Fourth Embodiment]

In the present embodiment, the order for overlapping the recording paper Q1-Q9 (externally outputted when divided-enlarged images are outputted) is changed from the order described in Embodiment 2.

Figure 7:
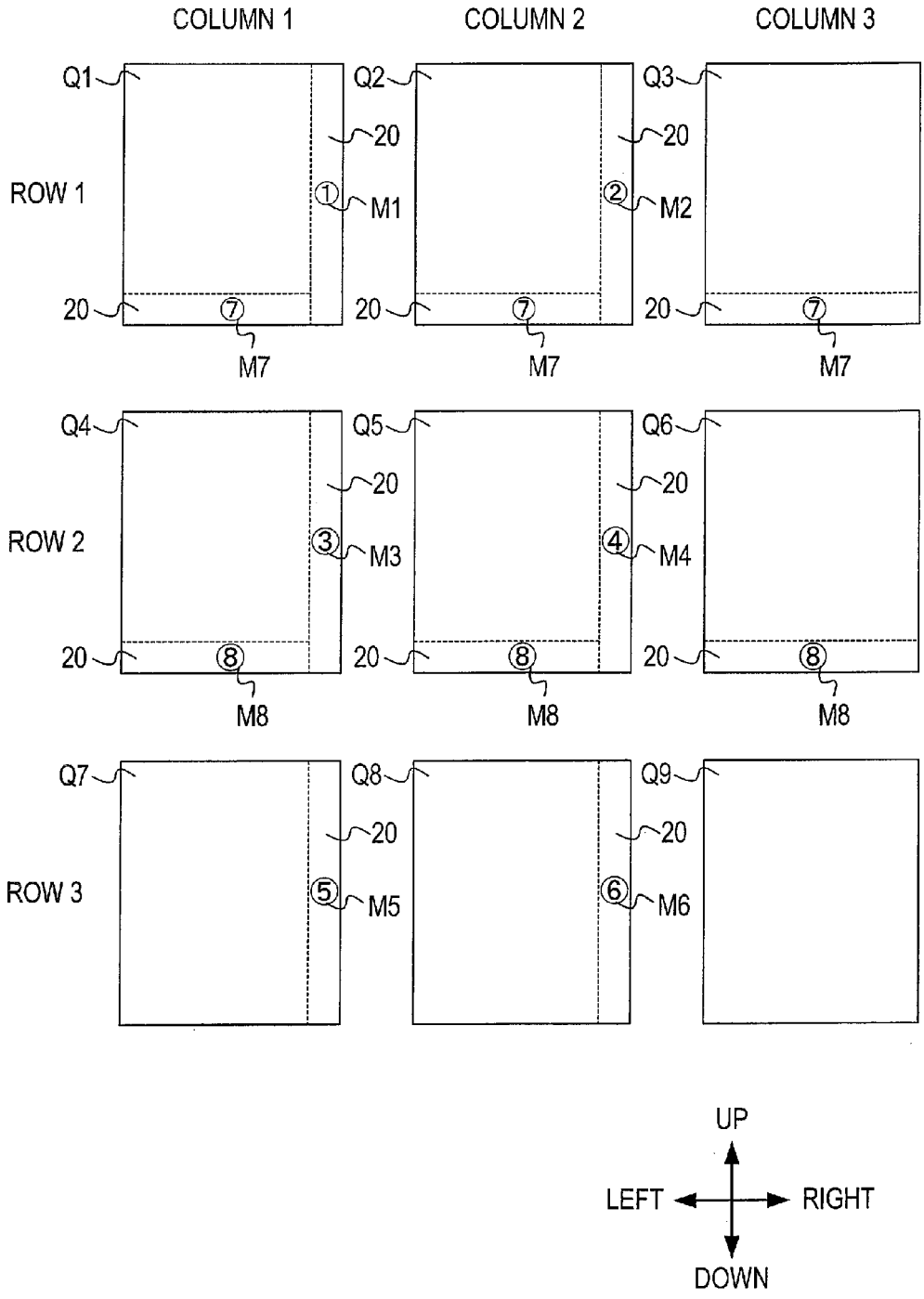
FIG. 7 is an explanatory view illustrating sheets of recording paper outputted by a multifunction apparatus according to a fourth embodiment when divided-enlarged images are outputted.

As shown in FIG. 7, the bond width 20 of the recording paper Q1, which will be disposed in Row 1, Column 1 in a complete state, is assigned with an overlap order number mark M1 in the portion (in the right end portion of the recording paper Q1) to be overlapped with the recording paper Q2. Additionally, the bond width 20 of the recording paper Q1 is assigned with an overlap order number mark M7 in the portion (in the bottom end portion of the recording paper Q1) to be overlapped with the recording paper Q4.

The bond width 20 of the recording paper Q2, which will be disposed in Row 1, Column 2 in the complete state, is assigned with an overlap order number mark M2 in the portion (in the right end portion of the recording paper Q2) to be overlapped with the recording paper Q3. Additionally, the bond width 20 of the recording paper Q2 is assigned with an overlap order number mark M7 in the portion (in the bottom end portion of the recording paper Q2) to be overlapped with the recording paper Q5. The bond width 20 of the recording paper Q3, which will be disposed in Row 1, Column 3, is assigned with an overlap order number mark M7 in the portion (in the bottom end portion of the recording paper Q3) to be overlapped with the recording paper Q6.

The bond width 20 of the recording paper Q4, which will be disposed in Row 2, Column 1 in the complete state, is assigned with an overlap order number mark M3 in the portion (in the right end portion of the recording paper Q4) to be overlapped with the recording paper Q5. Additionally, the bond width 20 of the recording paper Q4 is assigned with an overlap order number mark M8 in the portion (in the bottom end portion of the recording paper Q4) to be overlapped with the recording paper Q7.

The bond width 20 of the recording paper Q5, which will be disposed in Row 2, Column 2 in the complete state, is assigned with an overlap order number mark M4 in the portion (in the right end portion of the recording paper Q5) to be overlapped with the recording paper Q6. Additionally, the bond width 20 of the recording paper Q5 is assigned with an overlap order number mark M8 in the portion (in the bottom end portion of the recording paper Q5) to be overlapped with the recording paper Q8. The bond width 20 of the recording paper Q6, which will be disposed in Row 2, Column 3 in the complete state, is assigned with an overlap order number mark M8 in the portion (in the bottom end portion of the recording paper Q6) to be overlapped with the recording paper Q9.

The bond width 20 of the recording paper Q7, which will be disposed in Row 3, Column 1 in the complete state, is assigned with an overlap order number mark M5 in the portion (in the right end portion of the recording paper Q7) to be overlapped with the recording paper Q8. The bond width 20 of the recording paper Q8, which will be disposed in Row 3, Column 2 in the complete state, is assigned with an overlap order number mark M6 in the portion (in the right end portion of the recording paper Q8) to be overlapped with the recording paper Q9.

[Other Embodiments]

Although the magnifications for enlarging a read-out image in the poster copy function described in the above-described embodiments are ×4 and ×9, the present invention is not limited to the above-described examples. The magnification may be other sizes, such as ×16, ×25, and so on. Preferably, the setting for magnification for enlarging a read-out image may be changeable by a user, so that the magnification can be changed when the user uses the poster copy function. Specifically, the magnification of a read-out image may be changed through the process of the program described above by using FIG. 3. p Moreover, although the present invention is applied to a multifunction apparatus in the above-described embodiments, application of the present invention is not limited to the above-described examples. The present invention may alternatively be applied to a printer, or to an image formation system constituted with a printer and a personal computer. If the present invention is applied to an image formation system, the process of the program shown in FIG. 3 may be executed in the printer side, or in the computer side.

Furthermore, although bond widths are formed as overlap portions on recording paper in the above-described embodiments, the present invention is not limited to the above-described examples. Instead of the bond widths 20, overlap portions may be formed on recording paper in order to combine the sheets of recording paper by using a staple, a double-sided tape, and so on. In such case, overlap order number marks may be provided in the overlap portions.

Still furthermore, a portion of a divided read-out image that corresponds to a bond width formation area is deleted (S150 in FIG. 3) in the above-described embodiments. That is, no image is formed in the bond width 20. However, the present invention is not limited to the above-described example. The portion of a divided read-out image that corresponds to a bond formation area may not be necessarily deleted.

Additionally, a line may be formed so as to distinguish a bond width formation area (an overlap portion), used for forming a bond width 20, from an image formation area, used for forming a divided-enlarged image.

Although specific embodiments have been illustrated and described herein, it is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. An image forming apparatus comprising:

a formation unit that divides a predetermined image and forms divided images of the predetermined image on plurality sheets of recording paper in a divided manner, the formation unit forming the divided images such that, among the plurality sheets of recording paper, on which the divided images are formed by the formation unit, at least one of the plurality sheets of recording paper includes an overlap portion used for overlapping the at least one of the plurality sheets of recording paper with a remainder of the plurality sheets of recording paper; and an overlap order number assignment unit configured to print a mark, which shows an overlap order number indicating an overlap order of operation for overlapping the plurality sheets of recording paper in the overlap order indicated by the overlap order number, on the plurality sheets of recording paper at a position of the overlap portion to be assigned with the mark.

2. The image forming apparatus according to claim 1 wherein the overlap portion is a bond width to which glue is applied when the plurality sheets of recording paper are overlapped.

3. The image forming apparatus according to claim 2 wherein the overlap order number indicates an order for applying glue on the bond width.

4. The image forming apparatus according to claim 1 wherein the overlap portion is a portion used for fastening the plurality sheets of recording paper with a staple when the plurality sheets of recording paper are overlapped.

5. The image forming apparatus according to claim 1 wherein the overlap portion is a portion used for fastening the plurality sheets of recording paper with a double-sided tape when the plurality sheets of recording paper are overlapped.

6. The image forming apparatus according to claim 1 wherein the overlap order number is associated with a placement position where each of the plurality sheets of recording paper is disposed, when the plurality sheets of recording paper, on which the divided images are formed, are overlapped.

7. The image forming apparatus according to claim 1 wherein the formation unit forms the divided images such that the plurality sheets of recording paper are externally outputted in an order from one of the plurality sheets of recording paper having a smaller overlap order number.

8. The image forming apparatus according to claim 1 further comprising an overlap portion formation unit that forms the overlap portion on at least one of the plurality sheets of recording paper among the plurality sheets of recording paper, on which the divided images are formed, such that the overlap portion, used for overlapping the at least one of the plurality sheets of recording paper with a remainder of the plurality sheets of recording paper, is distinguished from a portion used for forming one of the divided images.

9. The image forming apparatus according to claim 8 wherein the overlap portion formation unit forms the overlap portion such that a portion of one of the divided images is deleted in the overlap portion.

10. The image forming apparatus according to claim 8 wherein the overlap portion formation unit forms an image for distinguishing between the portion used for forming one of the divided images and the overlap portion, on at least one of the plurality sheets of recording paper.

11. An image forming apparatus comprising:

a formation unit that divides a predetermined image and forms divided images of the predetermined image on plurality sheets of recording paper in a divided manner, the formation unit forming the divided images such that, among the plurality sheets of recording paper, on which the divided images are formed by the formation unit, at least one of the plurality sheets of recording paper includes an overlap portion used for overlapping the at least one of the plurality sheets of recording paper with a remainder of the plurality sheets of recording paper;

an overlap order number assignment unit that assigns the overlap portion with an overlap order number, indicating an overlap order for overlapping the plurality sheets of recording paper, in the overlap portion; and an overlap portion formation unit that forms the overlap portion on at least one of the plurality sheets of recording paper among the plurality sheets of recording paper, on which the divided images are formed, such that the overlap portion, used for overlapping the at least one of the plurality sheets of recording paper with a remainder of the plurality sheets of recording paper, is distinguished from a portion used for forming one of the divided images, wherein the overlap portion formation unit forms the overlap portion, distinguished from the portion used for forming one of the divided images, on each of the plurality sheets of recording paper, except for one of the plurality sheets of recording paper externally outputted last among the plurality sheets of recording paper on which the divided images are formed.

12. A non-transitory, computer-readable medium comprising an image formation program stored therein, the computer-readable medium being readable by a computer device that controls an image forming apparatus, the image formation program allowing the computer device to serve as a formation module that controls the image forming apparatus so as to divide a predetermined image and to form divided images of the predetermined image on a plurality sheets of recording paper in a divided manner, the formation module controlling the image forming apparatus such that, among the plurality sheets of recording paper, on which the divided images are formed by the formation module, at least one of the plurality sheets of recording paper includes an overlap portion used for overlapping the at least one of the plurality sheets of recording paper with a remainder of the plurality sheets of recording paper, the image formation program allowing the computer device to serve as an overlap order number assignment module that controls the image forming apparatus so as to print a mark, which shows an overlap order number indicating an overlap order of operation for overlapping the plurality sheets of recording paper in the overlap order indicated by the overlap order number on the plurality sheets of recording paper at a position of the overlap portion to be assigned with the mark.

13. The computer-readable medium according to claim 12 wherein the overlap portion is a bond width to which glue is applied when the plurality sheets of recording paper are overlapped.

14. The computer-readable medium according to claim 13 wherein the overlap order number indicates an order for applying glue on the bond width.

15. The computer-readable medium according to claim 12 wherein the overlap order number is associated with a placement position where each of the plurality sheets of recording paper is disposed, when the plurality sheets of recording paper, on which the divided images are formed, are overlapped.

16. The computer-readable medium according to claim 12 wherein the formation module controls the image forming apparatus so as to form the divided images such that the plurality sheets of recording paper are externally outputted in an order from one of the plurality sheets of recording paper having a smaller overlap order number.

17. The computer-readable medium according to claim 12 wherein the image formation program allows the computer device so as to serve as an overlap portion formation module that controls the image forming apparatus so as to form the overlap portion on at least one of the plurality sheets of recording paper among the plurality sheets of recording paper, on which the divided images are formed, such that the overlap portion, used for overlapping the at least one of the plurality sheets of recording paper with a remainder of the plurality sheets of recording paper, is distinguished from a portion used for forming one of the divided images.

18. The computer-readable medium according to claim 17 wherein the overlap portion formation module controls the image forming apparatus so as to form the overlap portion such that a portion of one of the divided images is deleted in the overlap portion.

19. The computer-readable medium according to claim 17 wherein the overlap portion formation module controls the image forming apparatus so as to form an image for distinguishing between the portion used for forming one of the divided images and the overlap portion on at least one of the plurality sheets of recording paper.

20. A non-transitory, computer-readable medium comprising an image formation program stored therein, the computer-readable medium being readable by a computer device that controls an image forming apparatus;

the image formation program allowing the computer device so as to serve as a formation module that controls the image forming apparatus so as to divide a predetermined image and to form divided images of the predetermined image on a plurality sheets of recording paper in a divided manner;

the formation module controlling the image forming apparatus such that, among the plurality sheets of recording paper, on which the divided images are formed by the formation module, at least one of the plurality sheets of recording paper includes an overlap portion used for overlapping the at least one of the plurality sheets of recording paper with a remainder of the plurality sheets of recording paper;

the image formation program allowing the computer device to serve as an overlap order number assignment module that controls the image forming apparatus so as to assign the overlap portion with an overlap order number, indicating an overlap order for overlapping the plurality sheets of recording paper, wherein the image formation program allows the computer device so as to serve as an overlap portion formation module that controls the image forming apparatus so as to form the overlap portion on at least one of the plurality sheets of recording paper among the plurality sheets of recording paper, on which the divided images are formed, such that the overlap portion, used for overlapping the at least one of the plurality sheets of recording paper with a remainder of the plurality sheets of recording paper, is distinguished from a portion used for forming one of the divided images, and wherein the overlap portion formation module controls the image forming apparatus so as to form the overlap portion, distinguished from the portion used for forming one of the divided images, on each of the plurality sheets of recording paper, except for one of the plurality sheets of recording paper externally outputted last among the plurality sheets of recording paper on which the divided images are formed.

* * * * *